United States Patent [19]

Epperson

[11] Patent Number: 4,489,839

[45] Date of Patent: Dec. 25, 1984

[54] TWO-WAY NESTING CONTAINER FOR LIQUIDS

[75] Inventor: Charles N. Epperson, Okmulgee, Okla.

[73] Assignee: Invention Development Equity Associates, Inc., Okmulgee, Okla.

[21] Appl. No.: 65,540

[22] Filed: Aug. 10, 1979

[51] Int. Cl.[3] ..... B65D 21/02

[52] U.S. Cl. ..... 215/10; 206/509; 222/143

[58] Field of Search ..... 206/509; 215/10; 222/143

[56] References Cited

U.S. PATENT DOCUMENTS

| | | | |
|---|---|---|---|
| 3,176,879 | 4/1965 | Mojonnier | 222/143 |
| 3,765,574 | 10/1973 | Urquiza | 222/143 |
| 3,782,602 | 1/1974 | Page | 222/143 |
| 3,889,834 | 6/1975 | Harris | 215/10 |

FOREIGN PATENT DOCUMENTS

| | | | |
|---|---|---|---|
| 1079538 | 4/1960 | Fed. Rep. of Germany | 206/509 |
| 2299237 | 8/1976 | France | 215/10 |
| 923151 | 4/1963 | United Kingdom | 222/143 |

*Primary Examiner*—George E. Lowrance
*Attorney, Agent, or Firm*—William S. Dorman

[57] ABSTRACT

A container for liquids having a vertical pouring spout at the upper end thereof and adjacent the side thereof, a recess in the bottom of the container for receiving the spout of a lower container when two or more containers are stacked in an upright nesting condition, and a recess in the top of the container in spaced relation to the spout for receiving the downwardly projecting spout of a super-imposed inverted container while the spout of the given container is simultaneously received in the recess in the top of the inverted container.

1 Claim, 13 Drawing Figures

TWO-WAY NESTING CONTAINER FOR LIQUIDS

BACKGROUND OF THE INVENTION

1. Field of the Invention

The present invention relates to a container for liquids and, more particularly, to a container having a spout thereon with provision on the container to permit upright and inverted stacking of the containers.

2. Description of the Prior Art

Containers having pouring spouts thereon are well known. The pouring spouts may be located at the center of the top of the container or adjacent the side edge of the container. Some spouts are even rotatable. Recently, one of the oil companies has come out with a new type of oil can or container with a spout in the center of the top, the spout being provided to assist in pouring for the filling of lawnmowers or the like. However, spouted containers can sometimes be inconvenient from the standpoint of handling, stacking, shipping etc.

SUMMARY OF THE INVENTION

The present invention provides a spouted container which can be arranged for display purposes in substantially the same manner as unspouted containers except that the spout on the uppermost container of a vertical stack will project above that uppermost container. The container of the present invention is also designed so that, for shipping purposes, the containers can be shipped in exactly the same manner as unspouted containers, providing that the containers are arranged at least two containers high in each shipping carton or box. More particularly, the container of the present invention, according to one embodiment, comprises a substantially cylindrical vertical wall having a substantially flat top and a substantially flat bottom. A cylindrical spout extends upwardly from the top of the container adjacent the side edge of the container. A first vertically extending recess is located in the bottom of the container along one side edge of the container so that, when one container is stacked on top of another container, both containers being in the upright position, the spout of the lower container will be received in the recess at the bottom of the upper container with no portion of the spout of the lower container projecting outwardly beyond the cylindrical wall of the upper container. Each container is also provided with a second recess extending vertically downward from the top of the container in spaced relation with respect to the spout. When a second container is stacked in inverted position upon a first container which is in upright position, the spouts of the two containers will be mutually received in the second recesses of the opposed containers, with no portions of the spouts extending outwardly beyond the cylindrical surfaces of the containers. In one form of the invention the two stacking recesses extend into each other to form a single recess extending for the full vertical height of the container in substantially parallel relation to the longitudinal axis of the container.

For the purpose of assisting in the stacking relation, a pair of pie-shaped projections are located at the top of each container and in spaced symmetrical relation to each other. Similarly, the bottom of each container is provided with a pair of pie-shaped recesses, also symmetrically spaced in relation to each other. The relationship between the pie-shaped projections and the pie-shaped recesses is such that, when the container is super-imposed in upright position over a second container also in upright position, the pie-shaped projections on the lower container will be received in the pie-shaped recesses in the bottom of the overlying container while the spout of the lower container will be simultaneously received in the vertical recess of the overlying container, as described above. When a container is placed in inverted position over another container which is in upright position, the pie-shaped projections on the upper container will be received between the pie-shaped projections at the top of the underlying container while the spouts of the two containers are mutually received within the vertical recesses provided at the intermating tops of the two containers.

In another form of the present invention, the container is substantially cubical in shape with the spout being located adjacent one corner at the top of the container. The corner of the cubical container diametrically opposite from the spout is the location for the first and second recesses which accommodate the spouts of other containers for upright or inverted stacking. Between the two stacking recesses, this diametrically opposite corner is provided with a cut-out portion so as to form a handle, and the portion of the corner which encloses the cut-out portion is thickened so as to reinforce the handle. The cubical container is also provided with nesting projections at the top and nesting recesses at the bottom; however, instead of being pie-shaped, the nesting projections and recesses are essentially triangular. It is believed that the cubical container could be provided in gallon and half-gallon sizes for milk, or the like. The cubical container can be stacked in exactly the same manner as the cylindrical container described above, in which case the spouts which are received in the recesses of the adjacent containers do not extend beyond the periphery of the containers.

DETAILED DESCRIPTION OF THE PREFERRED EMBODIMENTS

Figure 2:
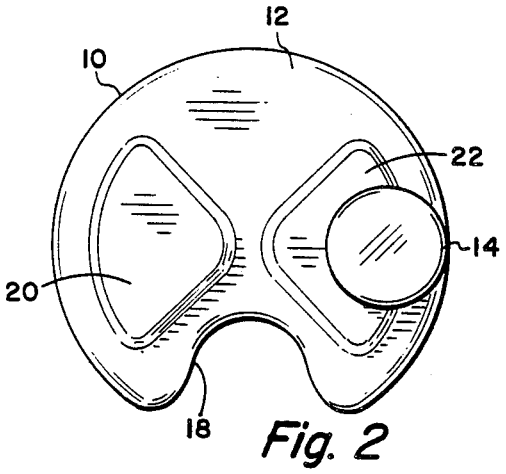
FIG. 2 is a top plan view of the container shown in FIG. 1.
Figure 1:
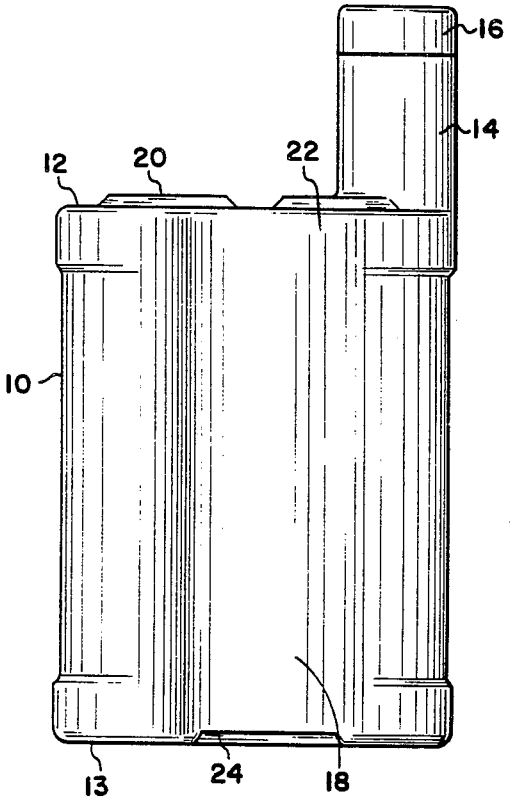
FIG. 1 is a front elevation of a container embodying one form of the present invention.

Referring to the drawings in detail, FIG. 1 shows a generally cylindrical container (or can) 10 having a generally flat top 12 and a generally flat bottom 13. The container 10 is preferably made of plastic material, but, obviously, it can be made out of any suitable material which is commonly employed to make cans, jars, bottles or the like for holding liquid therein. An essentially cylindrical pouring spout 14 is located at the top of the container adjacent the edge thereof as shown in FIGS. 1 and 2. The pouring spout 14 is hollow and communicates with the hollow interior of the container 10. The spout 14 is closed by a cap 16, which in the case of FIGS. 1 through 4 is threadedly received on the top of the spout 14. However, if desired, the spout 14 can be closed by a sheet or membrane of plastic material (not shown) which can be perforated or cut or otherwise removed to permit pouring of the contents from the can 10 through the pouring spout 14. A curved recess 18 is provided along one side of the container and extends from the top to the bottom thereof substantially parallel to the central axis of the cylindrical surface of the container 10. As best shown in FIG. 2, the recess 13 is formed as an indent in the outer side wall of the container 10. The inner portion of the curved recess 18 is of substantially the same shape and diameter as the spout 14, for a purpose which hereinafter appear.

Figure 3:
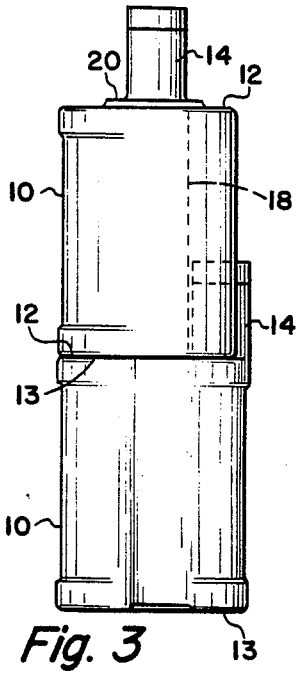
FIG. 3 is an elevational view, on a smaller scale, of two containers such as shown in FIG. 1, where the two containers are arranged in a vertically stacked condition with both containers being disposed in upright position.

FIG. 3 shows two containers or cans 10 stacked in upright position in such a manner that the spout 14 of the lowermost container 10 is received in the lower portion of the recess 18 of the upper container 10. The spout 14 of the uppermost container 10 projects above the assembly as shown. For the purpose of improving the nesting relationship shown in FIG. 3, a pair of pie-shaped raised portions 20 and 22 are provided on the top 12 of the container 10. One of these pie-shaped raised portions 22 surrounds and connects with or merges with the base of the spout 14. The bottom 13 of the container 10 is similarly provided with a pair of pie-shaped recesses 24 and 26 which best appear in FIG. 8 which shows a modified form of the container 10'. Each of the raised portions 20 and 22 and each of the recessed portions 24 and 26 occupy about 90° of the surface of the top or bottom of the can, respectively, and these raised portions and recesses are symmetrically arranged on the top and bottom, as shown. The longitudinal recess 18 is located about 90° away from the spout 14 as related to the cylindrical configuration of the container 10. Thus, when the two cans or containers 10 occupy the relative positions shown in FIG. 3, the upper raised portion 22 on the lower container 10 will be received in the lower recess 24 in the upper container 10; likewise, the raised portion 20 on the top 12 of the lower container 10 will be received in the recess 26 at the bottom of the upper container 10.

Figure 4:
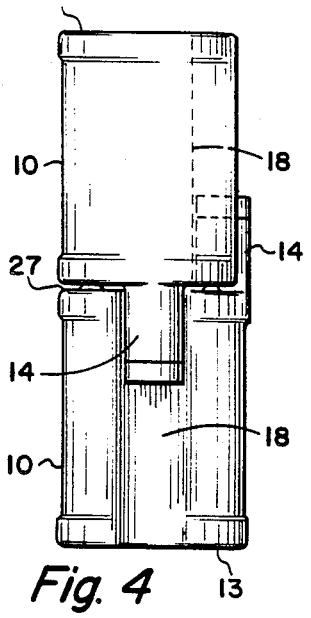
FIG. 4 is an elevational view, on a smaller scale, of two containers such as shown in FIG. 1, arranged in a stacking relation where the lower container is in a vertical upright position and the upper container is arranged in inverted position.

FIG. 4 shows a condition where two containers 10 are arranged in a nesting relation whereby the upper container 10 is inverted with respect to the lower container 10; in this instance, the spout 14 of the upper container 10 is received in the upper portion of the recess 18 of the lower container 10, whereas the spout 14 of the lower container 10 is received in the lower portion of the now inverted recess 18 of the upper container 10. The now downwardly directed pie-shaped projections 20 and 22 of the upper inverted container 10 will be received in the spaces between the raised projections 20 and 22 of the lower container 10, such that there is a slight separation 27 between the two containers as shown in FIG. 4. On the other hand, the bottom 13 of the upper container 10 in FIG. 3 fits nicely against the upper surface 12 of the lower container 10 in view of the intermating relationships between the projections 20 and 22 on the lower container and the recesses 24 and 26 on the bottom of the upper container 10.

Since many containers, such as oil cans, are arranged two-high in a shipping carton, the arrangement shown in FIG. 4 would be ideal for shipping purposes. The arrangement shown in FIG. 3 could be employed for display purposes. If, for any reason, it were desired to ship containers three-high in a shipping carton it would merely be necessary to add another inverted container 10 to the configuration shown in FIG. 3. If it were desired to ship containers four-high in a shipping carton, one could arrange to have the lower three containers 10 arranged in upright position as shown in FIG. 3, with the fourth and uppermost container inverted; alternatively, one could place two arrangements such as shown in FIG. 4 one on top of the other, in which case the containers would be inverted at alternate levels.

For the purpose of achieving the upright stacking arrangement shown in FIG. 3, it is not necessary that the containers 10 have an identical relationship between their spouts and associated recesses; however, for the inverted stacking arrangement shown in FIG. 4, it is necessary that the spouts 14 on the containers 10 be disposed in the same angular relationship with respect to their recesses 18 (or at least the upper ends of their recesses). In the case of FIGS. 1 through 4, the relationship between the spout 14 and the recess 18 is, as indicated above, approximately 90°; however, this relationship could be 180°, for example, providing the same relationship was employed on both containers shown in FIG. 4. This relationship, however, applies only to the upper portion of the recesses 18 as will appear below in connection with the description of FIGS. 5 through 8.

Figure 5:
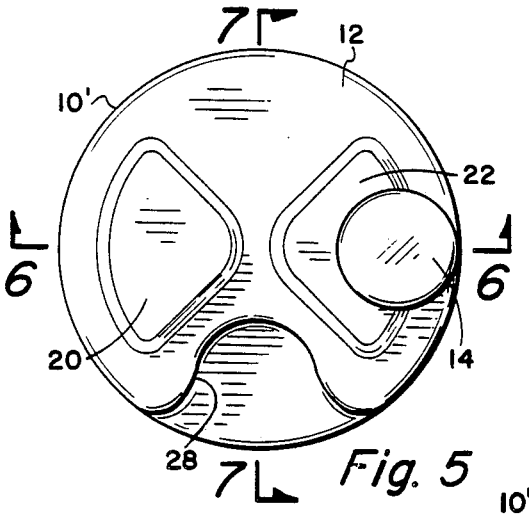
FIG. 5 is a top plan view, similar to FIG. 2, showing a modified form of container made in accordance with the present invention.
Figure 7:
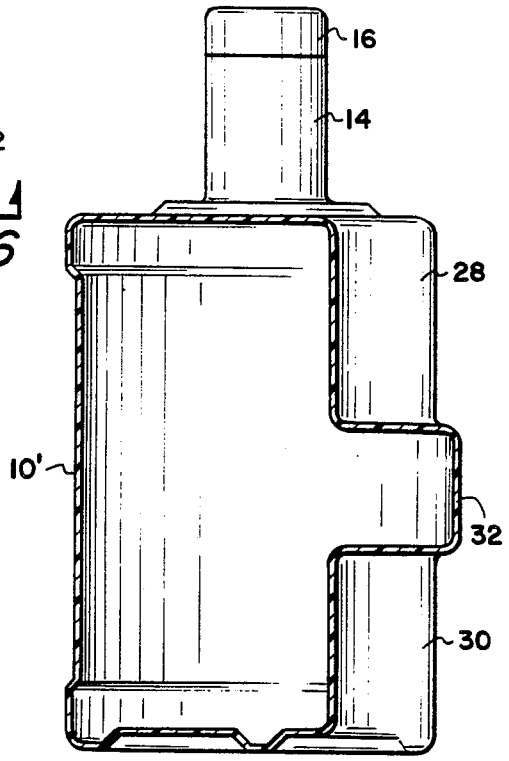
FIG. 7 is a vertical sectional view taken along section line 7—7 of FIG. 5.
Figure 6:
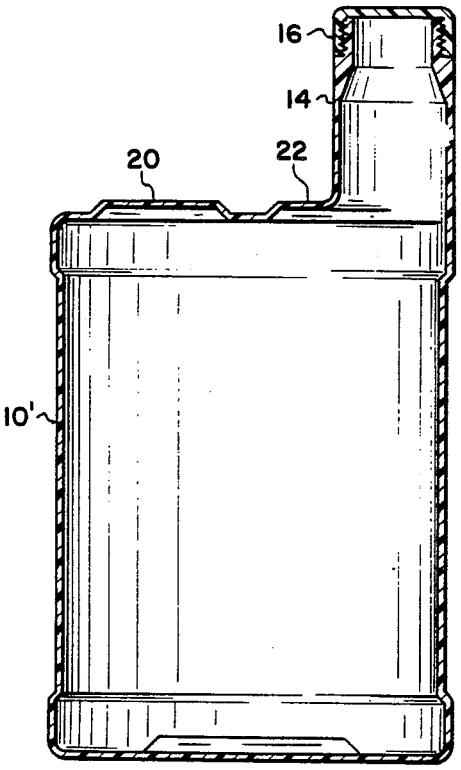
FIG. 6 is a vertical sectional view taken along section line 6—6 of FIG. 5.
Figure 8:
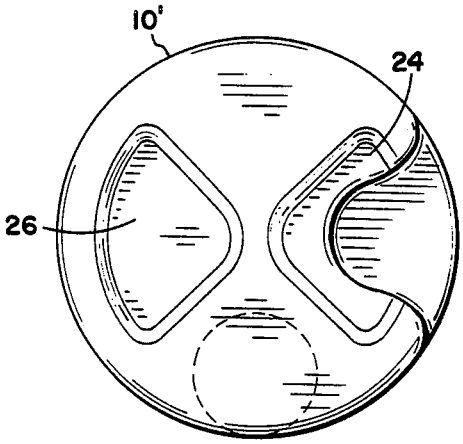
FIG. 8 is a bottom plan view of the container shown in FIGS. 5, 6 and 7.
Figure 9:
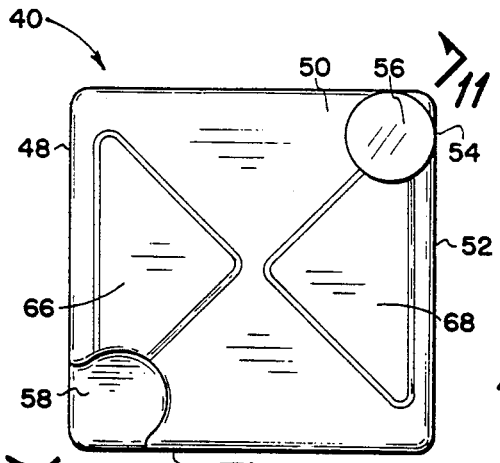
FIG. 9 is a top plan view of a container made in accordance with another modification of the present invention.
Figure 10:
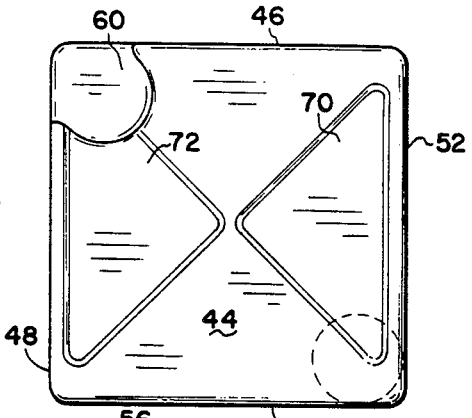
FIG. 10 is a bottom plan view of the container shown in FIG. 9.
Figure 11:
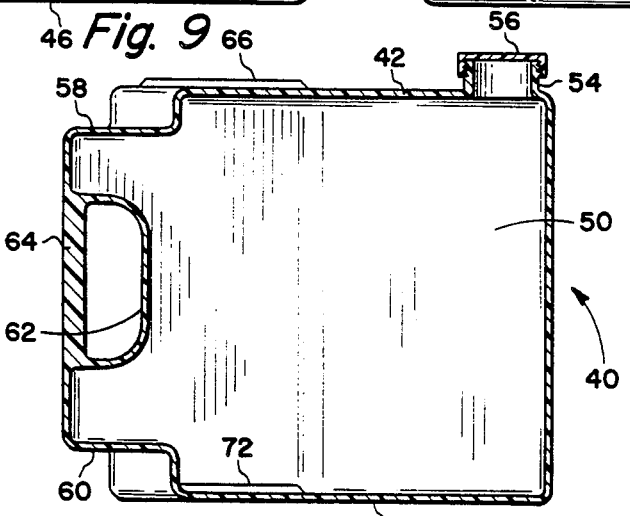
FIG. 11 is a vertical sectional view taken along section line 11—11 of FIG. 9.

The container 10' shown in FIGS. 5 through 8 is a slightly modified form of the container 10 shown in FIGS. 1 through 4. In the container shown in FIGS. 5 through 8, we do not have a continuous recess 18; instead, we have a pair of vertical recesses 28 and 30 which correspond, generally, to the upper and lower portions of the prior recess 18. These recesses 28 and 30 do not continue or extend for the full height of the container 10' but are separated from each other by an intermediate radial portion 32 which extends out to the normal diameter of the container 10'. As best shown in FIGS. 5, 7, and 8, these recesses 28 and 30 are formed as indents in the side wall of the container 10'. The container 10' is otherwise the same as the container 10 described in relation to FIGS. 1 through 4. If one were to stack the containers 10' in the manner shown in FIG. 3, the spout 14 on the lowermost container 10' would be received in the recess 30 of the upper container 10'. If one were to stack the containers 10' of FIGS. 5 through 8 in the manner shown in FIG. 4, the spout 14 of the lower container would be received in the recess 28 of the upper inverted container, whereas the inverted spout 14 of the upper container would be received in the upper recess 28 of the lower container. Otherwise, the stacking relationships of the container 10' would be exactly the same as that shown in FIGS. 3 and 4 for the container 10.

As indicated above, when the containers are stacked in the relationship shown in FIG. 3, the raised portions 20 and 22 fit into the recesses 26 and 24, respectively, so as to improve the nesting relationship; however, if the raised portions on the corresponding recesses were eliminated, such that the tops 12 and the bottoms 13 of the cans or containers 10 were essentially flat, it would not be necessary that the recess 30 be in alignment with the recess 28, because the location of the spout 14 on the uppermost can is wholly independent of the nesting of the lowermost spout 14 in the recess 30 in the upper container 10'. However, it is important that the upper recess 28 and the spout 14 have the same angular relationship on the upper and lower containers 10' when attempting to achieve the condition shown in FIG. 4; otherwise, the containers would simply not nest. It is not necessary, however, that this relationship be 90°; it could be 180° or 120° or some other angular relationship, just so long as the relationship was the same for both containers.

Referring now to FIGS. 9 through 13 inclusive, these figures show a liquid container having a different cross sectional shape, for example, square. This container 40 is provided with a generally flat top 42, a generally flat bottom 44 and vertical side wall means formed by four generally flat vertical sides 46, 48, 50 and 52. Thus, the container 40 is generally in the shape of a cube. A pouring spout 54 is located on the top 42 in the corner adjacent where the sides 50 and 52 come together. The pouring spout is provided with a cap 56 for sealing purposes. In the top 42, and in the corner opposite from the spout 54 is a recess 58 which is shaped so as to receive the spout 54 and cap 56 of a super-imposed and inverted container 40; when such an inverted container 40 is super-imposed on the given container 40 shown in FIG. 11, the spout 54 and cap 56 will likewise fit into the recess 58 provided in the top of the inverted container. In the bottom 44 of the container 40 is another recess 60 which is located directly below the recess 58. As shown in FIGS. 9 thru 12, these recesses 58 and 60 are formed as indents in the side walls of the container 40. As suggested above, both recesses 58 and 60 are located along the corner of the container 40 formed by the merger of the side walls 46 and 48. This same corner is provided with an opening or cutout portion 62 to provide a handle for lifting and pouring from the container 40. The portion of the corner which closes the opening 62 is thickened as at 64 to provide reinforcement for the resulting handle.

Figure 13:
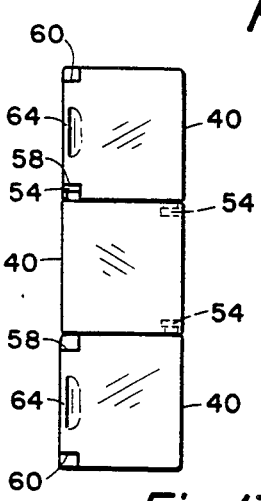
FIG. 13 is a vertical elevation showing three containers of the type shown in FIGS. 9 through 12 arranged in a vertical stacking relationship where the two lowermost containers are in upright position and the top uppermost container is inverted.
Figure 12:
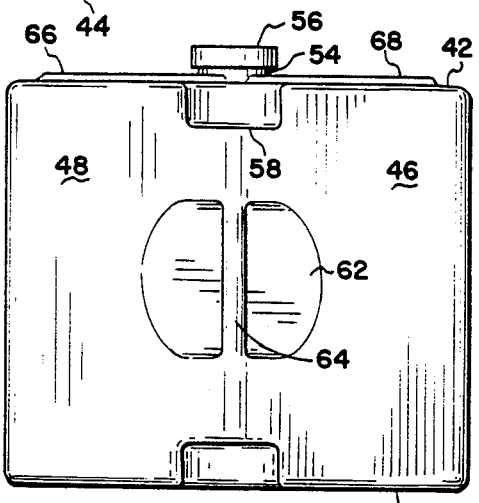
FIG. 12 is a vertical elevation of the container taken from the lower left hand corner of FIG. 9.

The top 42 of the container 40 is provided with a pair of triangular raised portions 66 and 68 which are symmetrically spaced and which occupy each about 90° of the surface of the top 42. Similarly, the bottom 44 of the container 40 is provided with a pair of triangular recesses 70 and 72 which are complementary to the raised portions 66 and 68. These recesses 70 and 72 also occupy approximately 90° each of the bottom 44 are symmetrically arranged. Thus, when a container 40, in upright position, is super-imposed on another container 40, also in upright position, the spout 54 and cap 56 of the lower container will be received in the recess 60 in the overlying upper container. At the same time, the triangular projections 66 and 68 in the top 42 of the lower container will fit into the recesses 70 and 72 in the bottom 44 of the overlying container. When an inverted container 40 is super-imposed on an upright container 40, the spout 54 and cap 56 of the upper inverted container will fit into the recess 58 on the top of the lower upright container, while the spout 54 and cap 56 of the lower container will simultaneously fit into the recess 58 in the top of the super-imposed and inverted container 40. The triangular projections 66 and 68 on the top of the super-imposed and inverted container will fit into the spaces between the recesses 66 and 68 on the top of the lower container. FIG. 13 shows an arrangement where three containers 40 are stacked one on top of the other, with the lower two containers in the upright position and the uppermost container being inverted.

Summarizing, the present invention provides a spouted container which can be displayed and shipped in substantially the same manner as an upspouted container. The container of the present invention can be made of plastic, metal or any other suitable material which has been used in the past for making containers. For display purposes, the container of the present invention can be stacked two, three, four or more high in substantially the same way as unspouted containers, the only essential difference being that the uppermost container will have its spout projecting above this container. For shipping purposes, the container of the present invention can be shipped two, three, four or more high in substantially the same manner as unspouted containers and without requiring any more shipping space. Since the uppermost container in any given vertical row will be inverted, there will be no projecting spouts which might otherwise interfere with the shipment of such spouted containers. When the containers are stacked one on top of each other for display or for shipping purposes, the spouts will be entirely contained within the boundaries defined by the outer vertical surfaces of the containers.

Whereas the present invention has been described in particular relation to the drawings attached hereto, it should be understood that other and further modifications, apart from those shown or suggested herein, may be made within the spirit and scope of this invention.

What is claimed is:

1. A container for holding liquids therein comprising a substantially vertical wall means closed at the top by a substantially flat top and closed at the bottom by a substantially flat bottom thereby defining a hollow container, a vertically directed hollow pouring spout extending upwardly from the top of said container adjacent said wall means and in communication with the interior of said container, means for closing the end of said spout, a first recess extending vertically upward from the bottom of said container along said wall portion and formed as an indent in said wall portion for receiving therein the spout of an underlying and upright container as defined above, and a second recess extending vertically downward from the top of said container along said wall portion and formed as an indent in said wall portion for receiving therein the spout of a super-imposed and inverted container as defined above while the spout of the given container is simultaneously received in the second recess in said super-imposed and inverted container, the flat top of each container being provided with at least one projection spaced from the spout, the flat bottom of each container being provided with at least one third recess spaced from the first recess whereby, when a container is super-imposed in upright position on a given container, each projection at the top of said given container will be received in a third recess in the bottom of the super-imposed container.

* * * * *